US006603447B1

(12) United States Patent
Ito et al.

(10) Patent No.: US 6,603,447 B1
(45) Date of Patent: Aug. 5, 2003

(54) METHOD OF DRIVING AC PLASMA DISPLAY PANEL

(75) Inventors: Yukiharu Ito, Osaka (JP); Shigeyuki Okumura, Osaka (JP)

(73) Assignee: Matsushita Electric Industrial Co., Ltd., Kadoma (JP)

( * ) Notice: Subject to any disclaimer, the term of this patent is extended or adjusted under 35 U.S.C. 154(b) by 0 days.

(21) Appl. No.: 09/547,209

(22) Filed: Apr. 11, 2000

(30) Foreign Application Priority Data

Apr. 20, 1999 (JP) ..... 11-112065

(51) Int. Cl.[7] ..... G09G 3/28; G09G 3/10

(52) U.S. Cl. ..... 345/60; 345/67; 345/68; 345/37

(58) Field of Search ..... 345/60, 68, 67, 345/37, 69, 71, 72, 87

(56) References Cited

U.S. PATENT DOCUMENTS

| | | | | |
|---|---|---|---|---|
| 5,745,086 A | | 4/1998 | Weber | |
| 5,877,734 A | * | 3/1999 | Amemiya | 345/60 |
| 5,963,184 A | * | 10/1999 | Tokumaga | 345/60 |
| 6,020,687 A | * | 2/2000 | Hirakawa et al. | 345/37 |
| 6,037,916 A | * | 3/2000 | Amemiya | 345/60 |
| 6,104,361 A | * | 8/2000 | Rutherford | 345/55 |
| 6,118,416 A | | 9/2000 | Nakamura et al. | |

FOREIGN PATENT DOCUMENTS

| | | |
|---|---|---|
| EP | 0836171 A2 | 4/1998 |
| JP | 6-289811 | 10/1994 |
| JP | 10-105111 | 4/1998 |

* cited by examiner

*Primary Examiner*—Steven Saras
*Assistant Examiner*—Alecia D. Nelson
(74) *Attorney, Agent, or Firm*—Merchant & Gould P.C.

(57) ABSTRACT

A method of driving an AC plasma display panel is provided, in which plural pairs of a scanning electrode and a sustain electrode covered with a dielectric layer and a plurality of data electrodes are arranged orthogonal to and opposing each other with a discharge space being sandwiched therebetween. The method includes an initialization period for applying, to the scanning electrode, an initialization waveform of a ramp voltage and a write period for applying, to the scanning electrode, a scanning waveform with a polarity opposite to that of the initialization waveform sequentially and at the same time applying, to the selected data electrodes, a data waveform with the same polarity as that of the initialization waveform. The potential of the scanning electrode to which the scanning waveform is being applied is set to be lower than that of the scanning electrode at the end of the application of the initialization waveform. In addition, the potential of the sustain electrode during the application of the scanning waveform is set to be lower than that of the sustain electrode at the end of the application of the initialization waveform.

2 Claims, 5 Drawing Sheets

METHOD OF DRIVING AC PLASMA DISPLAY PANEL

FIELD OF THE INVENTION

The present invention relates to a method of driving an AC plasma display panel used as an image display in a television receiver, a computer monitor, or the like.

BACKGROUND OF THE INVENTION

In a conventional AC plasma display panel (hereinafter referred to as a "panel"), as shown in FIG. 3, plural pairs of a scanning electrode 2 and a sustain electrode 3 are provided on a first glass substrate 1 in parallel with one another, and a dielectric layer 4 and a protective film 5 are provided so as to cover the pairs of the scanning electrode 2 and the sustain electrode 3. On a second glass substrate 6, a plurality of data electrodes 8 covered with a dielectric layer 7 are provided. On the dielectric layer 7, separation walls 9 are provided between every two of the data electrodes 8 in parallel to the data electrodes 8. Phosphors 10 are provided on the surface of the dielectric layer 7 and on side faces of the separation walls 9. The first glass substrate 1 and the second glass substrate 6 are positioned opposing each other with a discharge space 11 being sandwiched therebetween so that the scanning electrode 2 and the sustain electrode 3 are orthogonal to the data electrodes 8. A discharge cell 12 is formed between two adjacent separation walls 9 at the intersection of a data electrode 8 and a pair of the scanning electrode 2 and the sustain electrode 3. In the discharge spaces 11, xenon and at least one selected from helium, neon, and argon are filled as discharge gases.

The electrode array in this panel has a matrix form of M×N as shown in FIG. 4. In the column direction, M columns of data electrodes $D_1$ to $D_M$ are arranged, and N rows of scanning electrodes $SCN_1$ to $SCN_N$ and sustain electrodes $SUS_1$ to $SUS_N$ are arranged in the row direction. The discharge cell 12 shown in FIG. 3 corresponds to the region shown in FIG. 4.

FIG. 5 shows a timing chart of an operation driving waveform in a conventional driving method for driving this panel. In FIG. 5, one subfield is shown. One field for displaying one picture includes a plurality of subfields. The conventional driving method of driving this panel is described with reference to FIGS. 3 to 5 as follows.

As shown in FIG. 5, all the data electrodes $D_1$ to $D_M$ and all the sustain electrodes $SUS_1$ to $SUS_N$ are maintained at an electric potential of 0 (V) in an initialization operation in the first part of an initialization period. To all the scanning electrodes $SCN_1$ to $SCN_N$, a positive-polarity initialization waveform is applied, which increases rapidly from the potential of 0 (V) to an electric potential Vc (V) and then increases more gradually up to a potential Vd (V). At the potential Vc, the voltages of the scanning electrodes $SCN_1$ to $SCN_N$with respect to all the sustain electrodes $SUS_1$ to $SUS_N$ are below the firing voltage, and at the potential Vd, those voltages are beyond the firing voltage. During the gradual increase in the initialization waveform, first weak initialization discharges occur in respective discharge cells 12 from all the scanning electrodes $SCN_1$ to $SCN_N$to all the data electrodes $D_1$ to $D_M$ and all the sustain electrodes $SUS_1$ to $SUS_N$, respectively. Thus, a negative wall voltage is stored at the surface of the protective film 5 on the scanning electrodes $SCN_1$ to $SCN_N$. At the same time, positive wall voltages are stored at the surfaces of the phosphors 10 on the data electrodes $D_1$ to $D_M$ and at the surface of the protective film 5 on the sustain electrodes $SUS_1$ to $SUS_N$.

In an initialization operation in the second part of the initialization period, a potential Vq (V) is applied to all the sustain electrodes $SUS_1$ to $SUS_N$. At the same time, to all the scanning electrodes $SCN_1$ to $SCN_N$, a waveform is applied, which decreases rapidly from the potential Vd to a potential Ve (V) and then decreases more gradually to a potential Vi (V), thus completing the application of the initialization waveform. At the potential Ve, the voltages of the scanning electrodes $SCN_1$ to $SCN_N$with respect to all the sustain electrodes $SUS_1$ to $SUS_N$ are below the firing voltage, and at the potential Vi, those voltages are beyond the firing voltage. During the gradual decrease in the initialization waveform, second weak initialization discharges occur in the respective discharge cells 12 from all the data electrodes $D_1$ to $D_M$ and all the sustain electrodes $SUS_1$ to $SUS_N$ to all the scanning electrodes $SCN_1$ to $SCN_N$. Thus, the negative wall voltage at the surface of the protective film 5 on the scanning electrodes $SCN_1$ to $SCN_N$and the positive wall voltages at the surface of the protective film 5 on the sustain electrodes $SUS_1$ to $SUS_N$ and at the surfaces of the phosphors 10 on the data electrodes $D_1$ to $D_M$ are weakened to wall voltages suitable for a write operation. Thus, the initialization operation in the initialization period is completed.

In a write operation in the subsequent write period, the potential Vq is applied to all the sustain electrodes $SUS_1$ to $SUS_N$ continuously. Initially, a potential Vg (V) is applied to all the scanning electrodes $SCN_1$ to $SCN_N$. Then, to the scanning electrode $SCN_1$ in the first row, a scanning waveform of a potential Vi is applied, which has a polarity opposite to that of the initialization waveform and is the same potential as the potential Vi at the end of the initialization waveform. At the same time, a data waveform of a potential Vb (V) with the same polarity as that of the initialization waveform is applied to a designated data electrode $D_j$ (j indicates one or more designated integers of 1 to M) that is selected from the data electrodes $D_1$ to $D_M$ and corresponds to a discharge cell 12 to be operated so as to emit light in the first row. In this state, the potential difference between the surface of the protective film 5 on the scanning electrode $SCN_1$ and the surface of the phosphor 10 at the intersection (a first intersection) of the designated data electrode $D_j$ and the scanning electrode $SCN_1$ is calculated by subtracting the negative wall voltage at the surface of the protective film 5 on the. scanning electrode $SCN_1$ from the sum of the potential Vb of the data waveform and the positive wall voltage at the surface of the phosphor 10 on the data electrode $D_j$ (i.e. by adding the absolute values of them). Therefore, at the first intersection, a write discharge occurs between the designated data electrode $D_j$ and the scanning electrode $SCN_1$. At the same time, this write discharge induces a write discharge between the sustain electrode $SUS_1$ and the scanning electrode $SCN_1$ at the first intersection. Thus, at the first intersection, a positive wall voltage is stored at the surface of the protective film 5 on the scanning electrode $SCN_1$, and a negative wall voltage is stored at the surface of the protective film 5 on the sustain electrode $SUS_1$.

Then, to the scanning electrode SCN2 in the second row, a scanning waveform of a potential Vi is applied. At the same time, a data waveform of a potential Vb is applied to a designated data electrode $D_j$ that is selected from the data electrodes $D_1$ to $D_M$ and corresponds to a discharge cell 12 to be operated so as to emit light in the second row. In this state, the potential difference between the surface of the protective film 5 on the scanning electrode $SCN_2$ and the surface of the phosphor 10 at the intersection (a second intersection) of the designated data electrode $D_j$ and the scanning electrode $SCN_2$ is calculated by subtracting the negative wall voltage at the surface of the protective film 5 on the scanning electrode $SCN_2$ from the sum of the potential Vb of the data waveform and the positive wall voltage at the surface of the phosphor 10 on the data electrode $D_j$. Therefore, at the second intersection, a write discharge occurs between the designated data electrode $D_j$ and the scanning electrode $SCN_2$. At the same time, this write discharge induces a write discharge between the sustain electrode $SUS_2$ and the scanning electrode $SCN_2$ at the second intersection. Thus, at the second intersection, a positive wall voltage is stored at the surface of the protective film 5 on the scanning electrode $SCN_2$, and a negative wall voltage is stored at the surface of the protective film 5 on the sustain electrode $SUS_2$.

Successively, the same operation is carried out for all remaining rows up to the N row, thus completing the write operation in the write period.

In a sustain operation in a sustain period subsequent to the write period, a sustain waveform of a potential Vh (V) is applied alternately to all the scanning electrodes $SCN_1$ to $SCN_N$and all the sustain electrodes $SUS_1$ to $SUS_N$. Thus, in the discharge cells 12 in which the write discharges have occurred, sustain discharges are caused successively. Visible emission from the phosphors 10 excited by ultraviolet rays generated by the sustain discharges is used for display.

In an erase operation in an erase period subsequent to the sustain period, to all the sustain electrodes $SUS_1$ to $SUS_N$, an erase waveform is applied, which increases gradually from a potential of 0 (V) to a potential Vr (V). Thus, in the discharge cells 12 in which the sustain discharges have occurred, during the gradual increase in the erase waveform, a weak erase discharge occurs between a sustain electrode $SUS_i$ (i indicates one or more designated integers of 1 to N) and a scanning electrode $SCN_i$. Therefore, the negative wall voltage at the surface of the protective film 5 on the scanning electrode $SCN_i$ and the positive wall voltage at the surface of the protective film 5 on the sustain electrode $SUS_i$ are weakened, thus terminating the discharges. Thus, the erase operation in the erase period is completed.

However, in such a conventional driving method, a potential amplitude Vb of the data waveform is 80V, which is high. Therefore, a circuit for driving the data electrodes (a data-electrode driving circuit) used in this method is required to have a high withstand voltage of at least 80V, which causes a problem of high cost. Further, the power consumption of the data-electrode driving circuit is determined depending on: (data-electrode capacitance)×(repeated frequency of the data waveform)×(potential amplitude of the data waveform)$^2$×(the number of data electrodes). Therefore, for instance, in the case of a 42-inch-wide VGA panel, the maximum electric power consumption of the data-electrode driving circuit is 200 W, which is extremely high. This also has been a problem.

SUMMARY OF THE INVENTION

The present invention is intended to solve such problems and to provide a method of driving a panel, which enables cost reduction by lowering the withstand voltage of a data-electrode driving circuit and reduction in power consumption of the data-electrode driving circuit.

A method of driving an AC plasma display panel of the present invention is used for driving an Ac plasma display panel including: a first substrate and a second substrate, which are arranged opposing each other with a discharge space being sandwiched therebetween; plural pairs of a scanning electrode and a sustain electrode that are covered with a dielectric layer and are arranged on the first substrate; and a plurality of data electrodes orthogonal to and opposing the scanning electrode and the sustain electrode, which are provided on the second substrate. The driving method of the present invention employs an initialization period for applying, to the scanning electrode, an initialization waveform of a ramp voltage and a write period for applying, to the scanning electrode, a scanning waveform having a polarity opposite to that of the initialization waveform sequentially, and at the same time, applying, to the selected data electrodes, a data waveform having the same polarity as that of the initialization waveform. The potential of the scanning electrode during the application of the scanning waveform is set to be lower than that of the scanning electrode at the end of the application of the initialization waveform. In addition, the potential of the sustain electrode during the application of the scanning waveform is set to be lower than that of the sustain electrode at the end of the application of the initialization waveform.

According to this method, the potential amplitude of the data waveform applied to the data electrodes can be reduced. Therefore, the withstand voltage of a data-electrode driving circuit can be lowered and the cost of the data-electrode driving circuit can be reduced. Moreover, the power consumption of the data-electrode driving circuit also can be reduced.

DETAILED DESCRIPTION OF THE INVENTION

Figure 3:
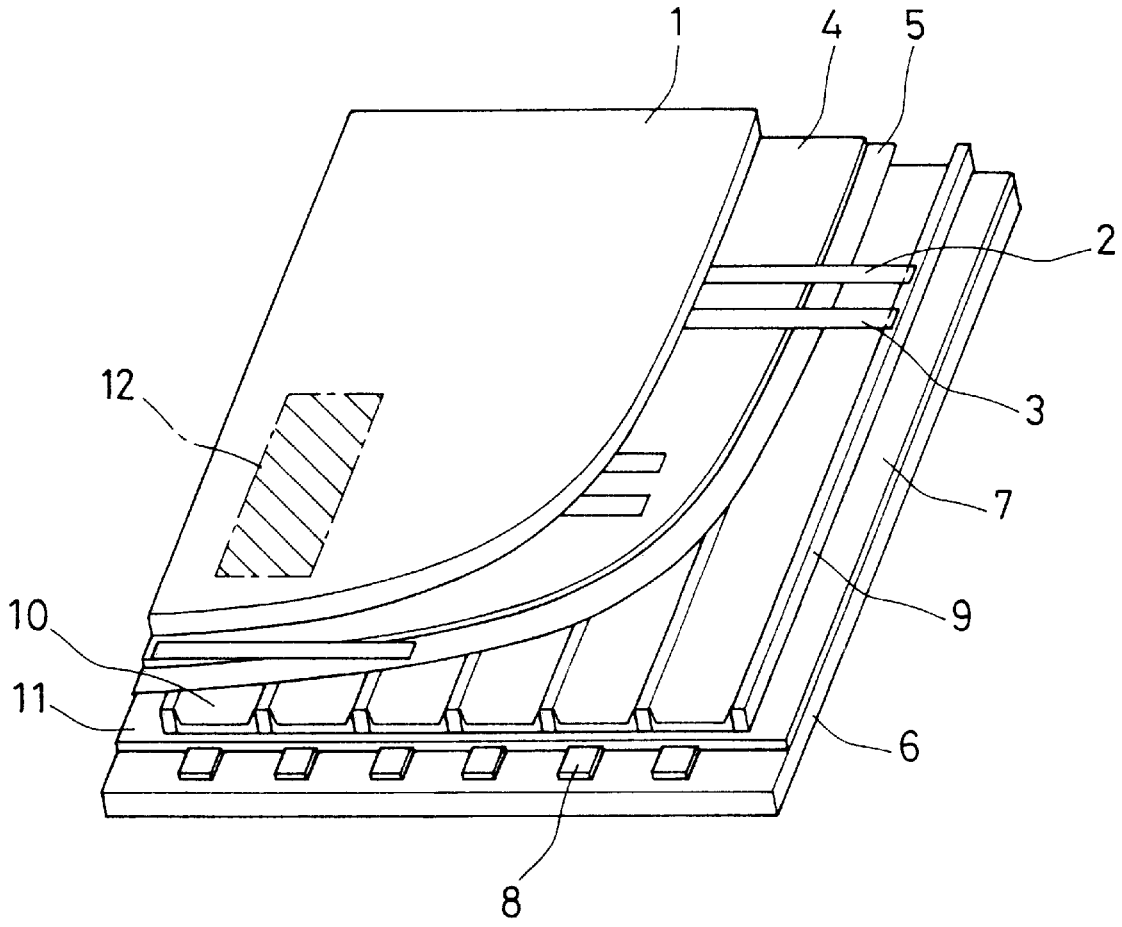
FIG. 3 PRIOR ART
FIG. 3 is a partially cutaway perspective view of a conventional panel.
Figure 4:
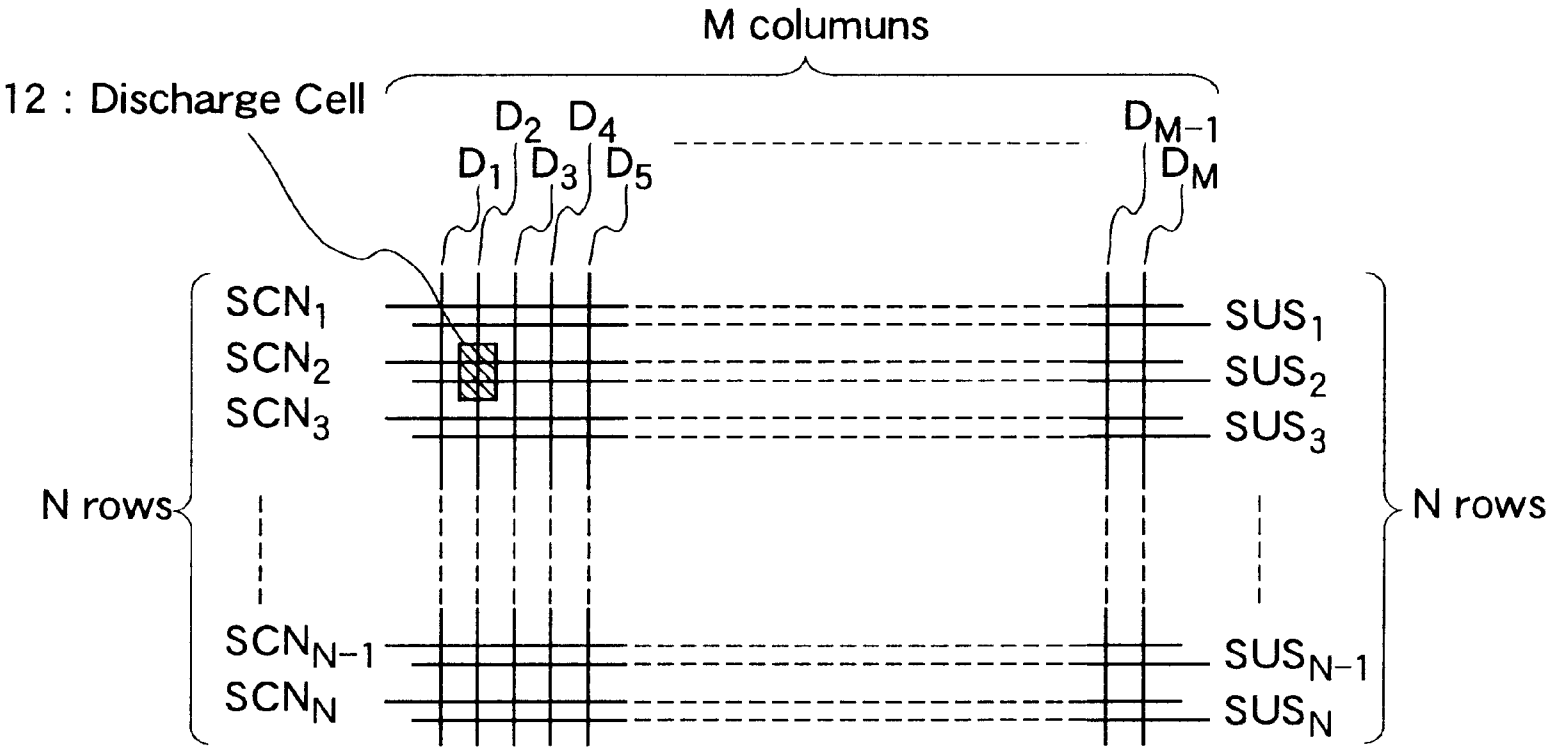
FIG. 4 PRIOR ART
FIG. 4 is a diagram showing an electrode array in the conventional panel.

An embodiment of the present invention is described with reference to the drawings as follows. In this embodiment, the same panel as the conventional panel shown in FIG. 3 is used and an electrode array in this panel is the same as that shown in FIG. 4. Therefore, their descriptions are not repeated.

Figure 1:
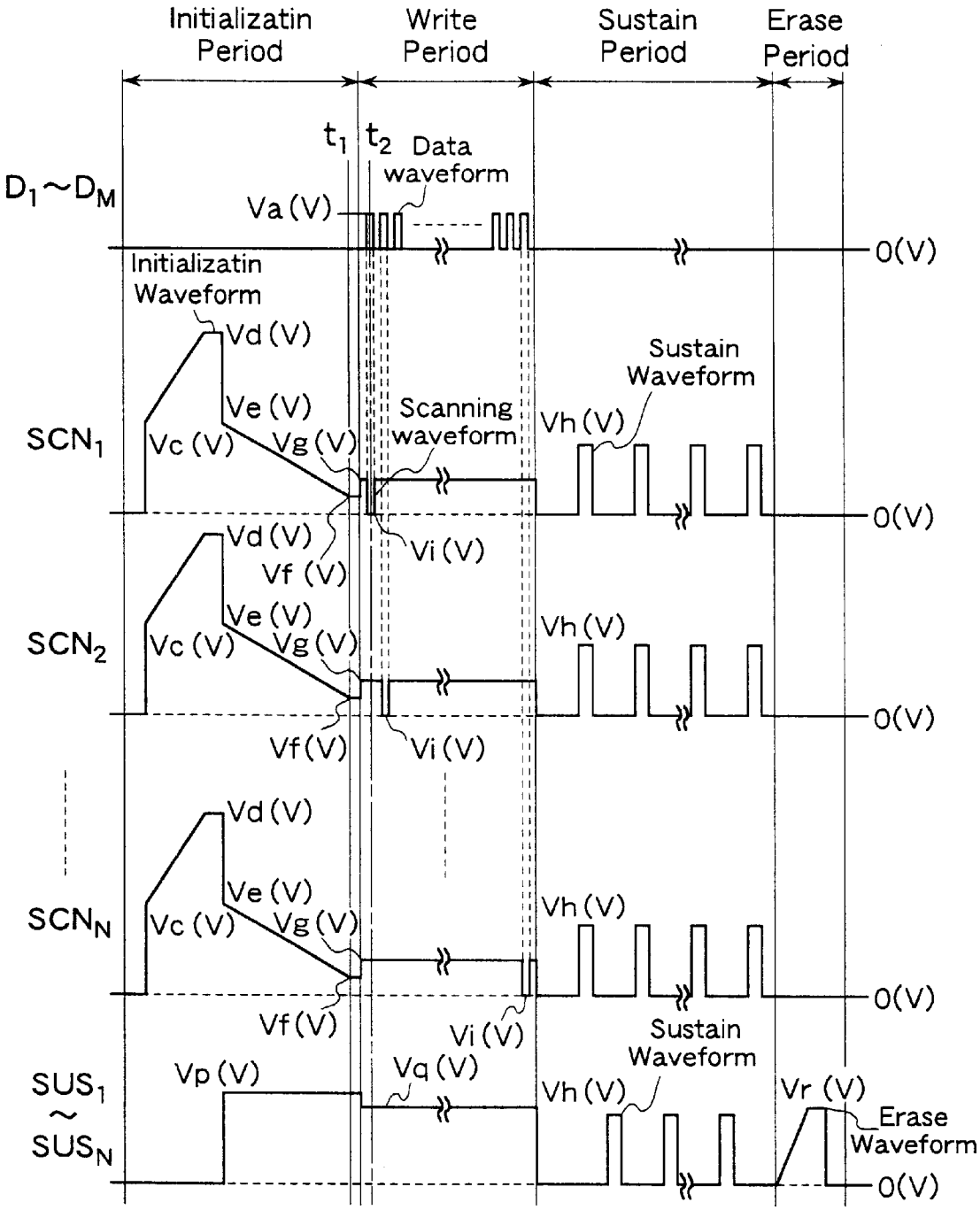
FIG. 1 shows a timing chart of an operation driving waveform illustrating a method of driving a panel according to an embodiment of the present invention.

FIG. 1 shows a timing chart of an operation driving waveform illustrating a method of driving a panel according to an embodiment of the present invention. Initially, all data electrodes $D_1$ to $D_M$ and all sustain electrodes $SUS_1$ to $SUS_N$ are maintained at an electric potential of 0 (V) in an initialization operation in the first part of an initialization period. To all scanning electrodes $SCN_1$ to $SCN_N$, a positive-polarity initialization waveform is applied, which increases rapidly from the potential of 0 (V) to a potential Vc (V) and then increases more gradually up to a potential Vd (V). At the potential Vc, the voltages with respect to all the sustain electrodes $SUS_1$ to $SUS_N$ are below the firing voltage, and at the potential Vd, those voltages are beyond the firing voltage. During the gradual increase in the initialization waveform (from the potential Vc to the potential Vd), first weak initialization discharges occur in respective discharge cells 12 from all the scanning electrodes $SCN_1$ to $SCN_N$ to all the data electrodes $D_1$ to $D_M$ and all the sustain electrodes $SUS_1$ to $SUS_N$, respectively. Thus, a negative wall voltage is stored at the surface of a protective film 5 on the scanning electrodes $SCN_1$ to $SCN_N$. At the same time, positive wall voltages are stored at the surfaces of phosphors 10 on the data electrodes $D_1$ to $D_M$ and at the surface of the protective film 5 on the sustain electrodes $SUS_1$ to $SUS_N$.

Next, in an initialization operation in the second part of the initialization period, a potential Vp (V) is applied to all the sustain electrodes $SUS_1$ to $SUS_N$. At the same time, to all the scanning electrodes $SCN_1$ to $SCN_N$, a waveform is applied, which decreases rapidly from the potential Vd to a potential Ve (V) and then decreases more gradually to a potential Vf (V), thus completing the application of the initialization waveform. At the potential Ve, the voltages of the scanning electrodes $SCN_1$ to $SCN_N$ with respect to all the sustain electrodes $SUS_1$ to $SUS_N$ are below the firing voltage, and at the potential Vf, those voltages are beyond the firing voltage. During the gradual decrease in this initialization waveform, second weak initialization discharges occur in the respective discharge cells 12 from all the data electrodes $D_1$ to $D_M$ and all the sustain electrodes $SUS_1$ to $SUS_N$ to all the scanning electrodes $SCN_1$ to $SCN_N$. Thus, the negative wall voltage at the surface of the protective film 5 on all the scanning electrodes $SCN_1$ to $SCN_N$, and the positive wall voltages at the surface of the protective film 5 on all the sustain electrodes $SUS_1$ to $SUS_N$ and at the surfaces of the phosphors 10 on all the data electrodes $D_1$ to $D_M$ are weakened. With the above operations, the wall voltage is adjusted to be suitable for a write operation subsequent to the initialization operation.

Thus, the initialization operation in the initialization period is completed.

In the write operation in the subsequent write period, a potential Vq (V) that is lower than the potential Vp is applied to all the sustain electrodes $SUS_1$ to $SUS_N$. To all the scanning electrodes $SCN_1$ to $SCN_N$, initially a potential Vg (V) is applied. Then, to the scanning electrode $SCN_1$ in the first row, a scanning waveform of a potential Vi (V) is applied, which has a polarity opposite to that of the initialization waveform and is lower than the potential Vf at the end of the application of the initialization waveform. At the same time, a data waveform of a potential Va (V) having the same polarity as that of the initialization waveform is applied to a designated data electrode $D_j$ that is selected from all the data electrodes $D_1$ to $D_M$ and corresponds to a discharge cell 12 to be operated so as to emit light in the first row. In this state, the potential difference between the surface of the protective film 5 on the scanning electrode $SCN_1$ and the surface of the phosphor 10 at the intersection (a first intersection) of the designated data electrode $D_j$ and the scanning electrode $SCN_1$ is calculated by subtracting the negative wall voltage at the surface of the protective film 5 on the scanning electrode $SCN_1$ from the sum of the positive wall voltage at the surface of the phosphor 10 on the data electrode $D_j$ and the difference between the potential Va of the data waveform and the potential Vi of the scanning waveform (i.e. by adding the absolute values of them). Therefore, a write discharge occurs between the designated data electrode $Dj$ and the scanning electrode $SCN_1$. At the same time, this write discharge induces a write discharge between the sustain electrode $SUS_1$ and the scanning electrode $SCN_1$ at the first intersection. Thus, a positive wall voltage is stored at the surface of the protective film 5 on the scanning electrode $SCN_1$ at the first intersection. In addition, a negative wall voltage is stored at the surface of the protective film 5 on the sustain electrode $SUS_1$ at the first intersection.

Then, to the scanning electrode $SCN_2$ in the second row, a scanning waveform of a potential Vi is applied, which has a polarity opposite to that of the initialization waveform and is lower than the potential Vf at the end of the application of the initialization waveform. At the same time, a data waveform of a potential Va having the same polarity as that of the initialization waveform is applied to a designated data electrode $D_j$ that is selected from all the data electrodes $D_1$ to $D_M$ and corresponds to a discharge cell 12 to be operated so as to emit light in the second row. In this state, the potential difference between the surface of the protective film 5 on the scanning electrode $SCN_2$ and the surface of the phosphor 10 at the intersection (a second intersection) of the designated data electrode $D_j$ and the scanning electrode $SCN_2$ is calculated by subtracting the negative wall voltage at the surface of the protective film 5 on the scanning electrode $SCN_2$ from the sum of the positive wall voltage at the surface of the phosphor 10 on the data electrode $D_j$ and the difference between the potential Va of the data waveform and the potential Vi of the scanning waveform. Therefore, a write discharge occurs between the designated data electrode $D_j$ and the scanning electrode $SCN_2$. At the same time, this write discharge induces a write discharge between the sustain electrode $SUS_2$ and the scanning electrode $SCN_2$ at the second intersection. Due to these write discharges, a positive wall voltage is stored at the surface of the protective film 5 on the scanning electrode $SCN_2$ at the second intersection. In addition, a negative wall voltage is stored at the surface of the protective film 5 on the sustain electrode $SUS_2$ at the second intersection.

Successively, the same operation is carried out. Finally, to the scanning electrode $SCN_N$ in the Nth row, a scanning waveform of a potential Vi is applied, which has a polarity opposite to that of the initialization waveform and is lower than the potential Vf at the end of the application of the initialization waveform. At the same time, a data waveform of a potential Va having the same polarity as that of the initialization waveform is applied to a designated data electrode $D_j$ that is selected from all the data electrodes $D_1$ to $D_M$ and corresponds to a discharge cell 12 to be operated so as to emit light in the Nth row. In this state, at the intersection (an Nth intersection) of the designated data electrode $D_j$ and the scanning electrode $SCN_N$, write discharges occur between the designated data electrode $D_j$ and the scanning electrode $SCN_N$ and between the sustain electrode $SUS_N$ and the scanning electrode $SCN_N$. Thus, at the Nth intersection, a positive wall voltage is stored at the surface of the protective film 5 on the scanning electrode $SCN_N$ and a negative wall voltage is stored at the surface of the protective film 5 on the sustain electrode $SUS_N$.

With the above operations, the write operation in the write period is completed.

In a sustain operation in a sustain period subsequent to the write period, initially the voltages of all the scanning electrodes $SCN_1$ to $SCN_N$ and all the sustain electrodes $SUS_1$ to $SUS_N$ are restored to the potential of 0 (V). Then, a sustain waveform of a positive potential Vh (V) is applied to all the scanning electrodes $SCN_1$ to $SCN_N$. In this state, at an intersection (a write intersection) of the designated data electrode $D_j$ and a designated scanning electrode $SCN_i$, which corresponds to a discharge cell 12 in which the write discharges have occurred, the potential difference between the surface of the protective film 5 on the scanning electrode $SCN_i$ and the surface of the protective film 5 on a sustain electrode $SUS_i$ is calculated by subtracting the negative wall voltage at the surface of the protective film 5 on the sustain electrode $SUS_i$ from the sum of the potential Vh and the positive wall voltage at the surface of the protective film 5 on the scanning electrode $SCN_i$, which has been stored in the write period. Therefore, a sustain discharge occurs between the scanning electrode $SCN_i$ and the sustain electrode $SUS_i$ at the write intersection. Due to the sustain discharge, a negative wall voltage is stored at the surface of the protective film 5 on the scanning electrode $SCN_i$ at the write intersection. In addition, a positive wall voltage is stored at the surface of the protective film 5 on the sustain electrode $SUS_i$. After that, the sustain waveform is restored to the potential of 0 (V).

Next, the sustain waveform of the positive potential Vh is applied to all the sustain electrodes $SUS_1$ to $SUS_N$. Thus, the potential difference between the surface of the protective film 5 on the sustain electrode $SUS_i$ and the surface of the protective film 5 on the scanning electrode $SCN_i$ at an intersection in which write has been carried out is calculated by subtracting the negative wall voltage at the surface of the protective film 5 on the scanning electrode $SCN_i$ from the sum of the potential Vh and the positive wall voltage at the surface of the protective film 5 on the sustain electrode $SUS_i$. Therefore, a sustain discharge occurs between the sustain electrode $SUS_i$ and the scanning electrode $SCN_i$ at the write intersection. Thus, a negative wall voltage is stored at the surface of the protective film 5 on the sustain electrode $SUS_i$ at the write intersection. In addition, a positive wall voltage is stored at the surface of the protective film 5 on the scanning electrode $SCN_i$. After that, the sustain waveform is restored to the potential of 0 (V).

Successively, in the same way, the sustain waveform of the positive potential Vh is applied alternately to all the scanning electrodes $SCN_1$ to $SCN_N$ and all the sustain electrodes $SUS_1$ to $SUS_N$. Thus, the sustain discharges are caused successively. At the end of the sustain period, the sustain waveform of the positive potential Vh is applied to all the scanning electrodes $SCN_1$ to $SCN_N$. In this state, a sustain discharge occurs between the scanning electrode $SCN_i$ and the sustain electrode $SUS_i$ at the write intersection. Thus, a negative wall voltage is stored at the surface of the protective film 5 on the scanning electrode $SCN_i$ at the write intersection. In addition, a positive wall voltage is stored at the surface of the protective film 5 on the sustain electrode $SUS_i$. After that, the sustain waveform is restored to the potential of 0 (V).

With the above operations, the sustain operation in the sustain period is completed. Visible emission from the phosphors 10 excited by ultraviolet rays generated by those sustain discharges is used for display.

In an erase operation in an erase period subsequent to the sustain period, an erase waveform is applied to all the sustain electrodes $SUS_1$ to $SUS_N$, which increases gradually from a potential of 0 (V) to a potential Vr (V). During the gradual increase in the erase waveform, a weak erase discharge occurs between the sustain electrode $SUS_i$ and the scanning electrode $SCN_i$ at the intersection where the sustain discharge has occurred. Due to this erase discharge, the negative wall voltage at the surface of the protective film 5 on the scanning electrode $SCN_i$ and the positive wall voltage at the surface of the protective film 5 on the sustain electrode $SUS_i$ are weakened, thus terminating the discharges. Thus, the erase operation is completed.

In the above operations, with respect to a discharge cell that is not operated to emit light, the initialization discharge occurs in the initialization period, but the write discharge, the sustain discharge, and the erase discharge are not caused. Therefore, the wall voltage at the surface of the phosphor 10 on a data electrode Dh (other than the designated data electrode $D_j$ ) and the wall voltage at the surface of the protective film 5 on the scanning electrode $SCN_i$ and the sustain electrode $SUS_i$ that correspond to the discharge cell that is not operated to emit light are maintained in the state at the end of the initialization period.

A series of operations in the initialization period, the write period, the sustain period, and the erase period are set to be one subfield, and one field for displaying one picture includes, for example, eight subfields. The luminance of light emitted from discharge cells to be operated in those respective subfields is determined depending on the number of applications of the sustain waveform. Therefore, by setting the respective subfields to have the number of sustain waveforms in the ratio of $2^0:2^1:2^2:\ldots:2^7$, a display having $2^8=256$ shades of gray can be carried out. Thus, images can be displayed in a television receiver, a computer monitor, or the like.

The following description is directed to differences between the method of driving a panel according to the embodiment of the present invention described above and the conventional method.

A first different aspect resides in that a potential of a scanning electrode to which a scanning waveform is being applied, for instance the potential Vi of the scanning electrode $SCN_1$ at the time t2 shown in FIG. 1, is lower than the potential Vf of the scanning electrode at the time t1 at the end of the application of the initialization waveform.

Figure 5:
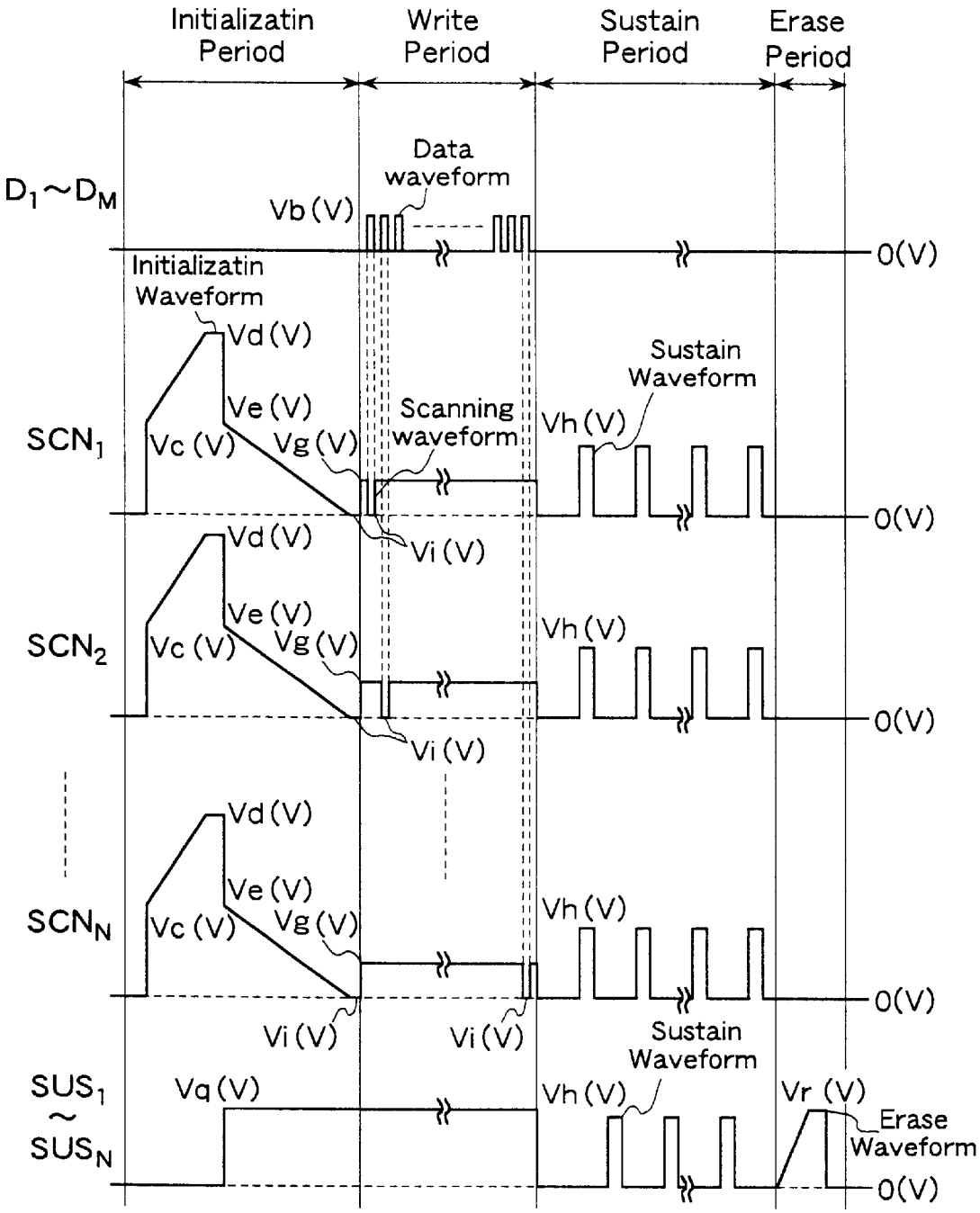
FIG. 5 PRIOR ART
FIG. 5 shows a timing chart of an operation driving waveform illustrating a conventional method of driving the conventional panel.

In the conventional driving method, the potential differences between the surface of the protective film 5 on the scanning electrodes and the surfaces of the phosphors 10 at the end of the initialization operation were unified among all the discharge cells. Therefore, a stable write operation was able to be carried out, but the potential difference was slightly smaller than an ideal potential difference for the write operation. Such a potential difference was caused because wall voltages were adjusted using the initialization waveform having a gentle downward gradient from the potential Ve to the potential Vi as shown in FIG. 5. Consequently, the threshold voltage of the data waveform applied in the write operation was high and this was compensated by the potential amplitude of the data waveform, thus causing a high potential amplitude of the conventional data waveform.

By providing the first different aspect described above, the potential difference between the surface of the protective film 5 on the scanning electrode $SCN_i$ and the surfaces of the phosphors 10 at the intersections of all the data electrodes $D_1$ to $D_M$ and the scanning electrode $SCN_i$ to which the scanning pulse is being applied in the write operation is increased further by the potential difference Vf−Vi from the potential difference in the state after the adjustment by the gradual downward gradient (the gradient from the potential Ve to the potential Vf in FIG. 1) in the initialization waveform. In this case, however, the potential difference Vf−Vi is limited to be set in a range in which no error discharge is caused in discharge cells intended not to emit light. As mentioned above, the threshold voltage of the data waveform in the write operation is lowered by the potential difference Vf−Vi by which the potential amplitude of the data waveform can be reduced compared to that in the conventional method.

However, when only the above-mentioned first different aspect is adopted, an error discharge in a discharge cell intended not to emit light tends to be caused upon the application of the scanning waveform between the surface of the protective film 5 on the sustain electrode $SUS_i$ and the surface of the protective film 5 on the scanning electrode $SCN_i$ to which the scanning waveform has been applied. When the prevention of this error discharge is sought, only a small potential difference Vf−Vi can be set. As a result, the potential amplitude of the data waveform can be reduced only slightly. Therefore, the following second different aspect is provided to reduce the potential amplitude of the data waveform considerably.

The second different aspect resides in that the potential Vq of a sustain electrode during the application of the scanning waveform (for example, at the time t2 in the case of the scanning electrode $SCN_1$) is lower than the potential Vp of a sustain electrode at the time t1 at the end of the application of the initialization waveform. When only the first different aspect is adopted, the potential difference between the surface of the protective film 5 on the scanning electrode $SCN_i$ and the surface of the protective film 5 on the sustain electrode $SUS_i$ increases by Vf−Vi during the application of the scanning waveform compared to the potential difference at the end of the application of the initialization waveform. On the other hand, when the second different aspect also is adopted, the potential difference between the surface of the protective film 5 on the scanning electrode $SCN_i$ and the surface of the protective film 5 on the sustain electrode $SUS_i$ increases by Vf−Vi−(Vp−Vq) during the application of the scanning waveform compared to the potential difference at the end of the application of the initialization waveform. In other words, when compared to the case where only the first different aspect is adopted, the potential difference between the surface of the protective film 5 on the scanning electrode $SCN_i$ and the surface of the protective film 5 on the sustain electrode $SUS_i$ can be reduced by Vp−Vq. Consequently, when the scanning waveform is applied to the scanning electrode $SCN_i$, an error discharge in a discharge cell intended not to emit light is not caused easily. Thus, the potential difference Vf−Vi can be set to be large in a range in which no error discharge is caused between the surface of the protective film 5 on the scanning electrode $SCN_i$ and the surfaces of the phosphors 10 in discharge cells intended not to emit light at the intersections of the data electrodes $D_1$ to $D_M$ and the scanning electrode $SCN_i$ to which the scanning pulse is being applied. As a result, the potential amplitude Va of the data waveform can be reduced considerably.

Figure 2:
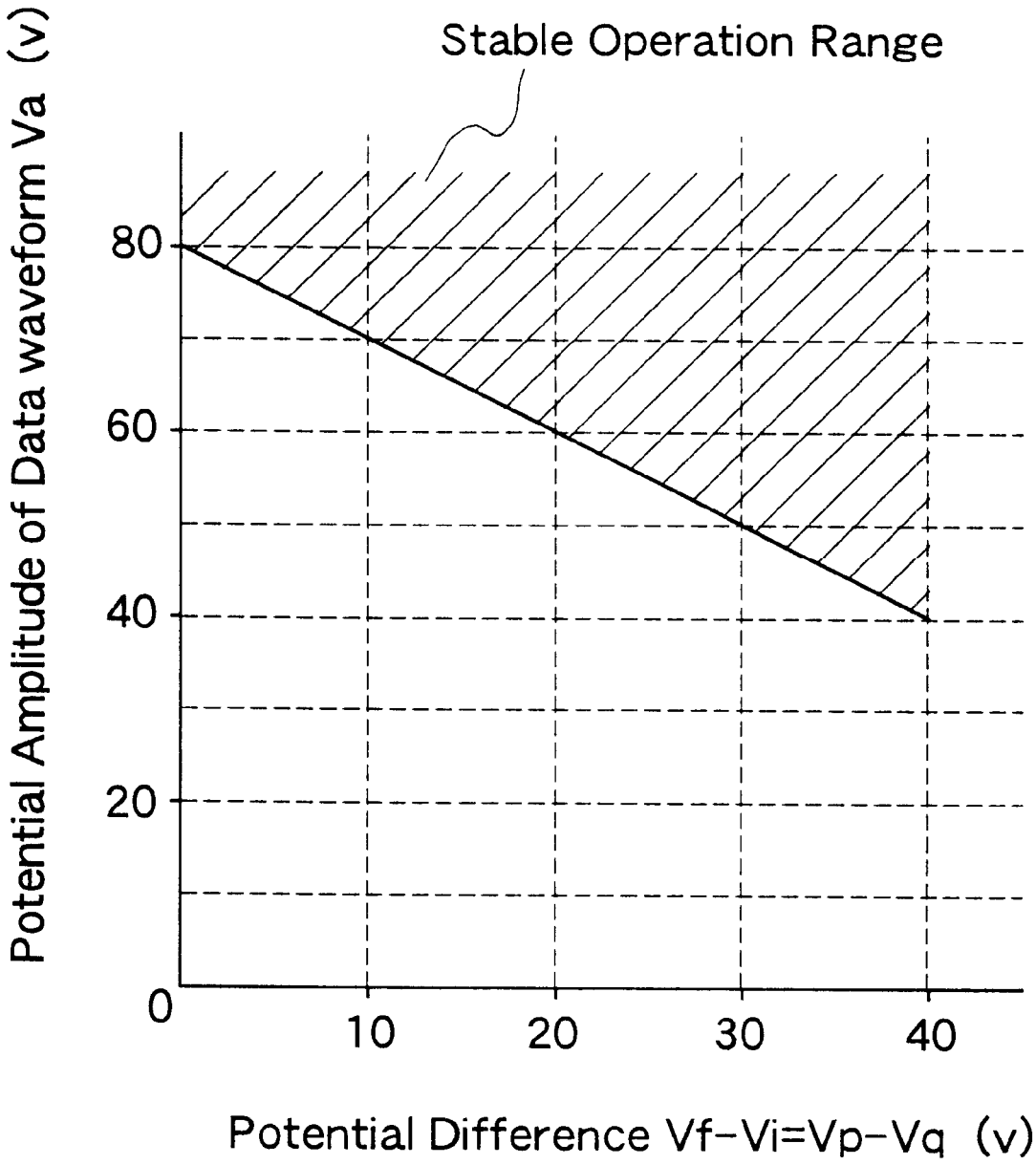
FIG. 2 is a graph showing the relationship between potential differences Vf−Vi and Vp−Vq and a potential amplitude Va of a data waveform in a method of driving a panel according to an embodiment of the present invention.

FIG. 2 shows measurement results illustrating the relationship between the potential amplitude Va of the data waveform and the potential differences of Vf−Vi and Vp−Vq in a method of driving a panel according to an embodiment of the present invention. The measurement was carried out using a panel with a diagonal length of 42 inches having 480×(852×3) (dots) discharge cells, each of which had a size of 1.08 mm×0.36 mm. The set conditions in the measurement were Vd=450V, Vg=80V, Vi=0V, Vc=Ve=Vh=Vq=Vr=190V. In addition, the width and the cycle of the data waveform were set to be 2 μs and 2.5 μs, and the time required for the gradual decrease in the initialization waveform (the time required from the potential Ve to the potential Vf) was set to be 150 μs. By varying the potentials Vf and Vp, the potential differences Vf−Vi and Vp−Vq were varied simultaneously while having the same potential difference.

It can be seen from FIG. 2 that when both the potential differences Vf−Vi and Vp−Vq are set to be 40V, the potential amplitude Va of the data waveform decreases to 40V. When the potential difference Vf−Vi is set to be above 40V, write discharges tend to occur easily merely by the application of the scanning waveform in discharge cells intended not to emit light, which is not practical. Therefore, by setting the values of the potential differences Vf−Vi and Vp−Vq to be higher than 0V but not higher than 40V, the potential amplitude Va of the data waveform can be reduced without causing error discharges by the write operation. Consequently, a withstand voltage required in a data-electrode driving circuit can be lowered, thus reducing the cost of the data-electrode driving circuit. Moreover, when the potential amplitude Va of the data waveform is set to be 40V, the maximum electric power consumption of the data-electrode driving circuit is reduced considerably to 50 W, which is 25% in the conventional method. Further, when the potential difference Vf−Vi is set to be 10V, the potential amplitude Va is reduced to 70V, thus reducing the maximum electric power consumption of the data-electrode driving circuit by 50 W compared to that in the conventional case. Consequently, not only a radiation mechanism of the data-electrode driving circuit can be simplified but also the reliability of the circuit is improved. Therefore, further preferably, the potential difference Vf−Vi is set to be at least 10V in actual use.

In this measurement, the potential differences Vp−Vq and Vf−Vi are set to be the same, but the potential difference Vp−Vq may be set to be slightly different from the potential difference Vf−Vi to maximize the margin for error discharges.

The above embodiment was directed to the case where the reference potential of the respective driving waveforms applied to the scanning electrodes $SCN_1$ to $SCN_N$, the sustain electrodes $SUS_1$ to $SUS_N$, and the data electrodes $D_1$ to $D_M$ was set to be 0V. However, the present invention also can be applied to the case where the reference potential of the respective driving waveforms is set to be a potential other than 0V. In this panel, discharge cells are surrounded by a dielectric and the respective driving waveforms are applied to the discharge cells in a manner of capacitive coupling. Therefore, its operation is not changed even if the DC level of each driving waveform is shifted.

In the above-mentioned embodiment, the initialization waveform was allowed to increase gradually from the potential Vc to the potential Vd in the first part of the initialization period. However, when it is not particularly necessary to suppress light emission caused by the initialization waveform, the potential may be increased rapidly from 0V to the potential Vd. Furthermore, the time required for the gradual increase or decrease in the initialization waveform, i.e. the time required for the increase from the potential Vc to the potential Vd or from the potential Ve to the potential Vf is at least 10 μs. This time is sufficiently longer than a discharge retardation time of several hundreds ns, and during this time, the initialization operation can be completed stably. Generally, the upper limit of a refresh time of a display screen is about 16 ms. Therefore, the time required for the gradual increase and decrease in the initialization waveform is 10 ms or less as a practical range.

The invention may be embodied in other forms without departing from the spirit or essential characteristics thereof The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. A method of driving an AC plasma display panel including: a first substrate and a second substrate, which are arranged opposing each other with a discharge space being sandwiched therebetween; plural pairs of a scanning electrode and a sustain electrode that are covered with a dielectric layer and are arranged on the first substrate; and a plurality of data electrodes orthogonal to and opposing the scanning electrode and the sustain electrode, the plurality of data electrodes being provided on the second substrate, comprising:

an initialization period for applying, to the scanning electrode, an initialization waveform of a ramp voltage and for applying, to the sustain electrode, a predetermined voltage; and a write period directly following the initialization period for applying, to the scanning electrode, a scanning waveform having a polarity opposite to that of the initialization waveform sequentially and at the same time selectively applying, to the data electrodes, a data waveform with the same polarity as that of the initialization waveform, wherein a potential of the scanning electrode to which the scanning waveform during the write period is being applied is set to be lower than that of the scanning electrode at an end of application of the initialization waveform during the initialization period, and a potential of the sustain electrode to which the scanning waveform during the write period is being applied is set to be lower than that of the sustain electrode at the end of the application of the initialization waveform during the initialization period.

2. The method of driving an AC plasma display panel according to claim 1, wherein an absolute value of the difference between the potential of the scanning electrode at the end of the application of the initialization waveform and the potential of the scanning electrode to which the scanning waveform is being applied and an absolute value of the difference between the potential of the sustain electrode at the end of the application of the initialization waveform and the potential of the sustain electrode in the write period are higher than 0V but not higher than 40V.

* * * * *